United States Patent [19]

Osada et al.

[11] 4,164,270

[45] Aug. 14, 1979

[54] MAST SUPPORT CONSTRUCTION FOR FORK LIFT TRUCK

[75] Inventors: Hiroshi Osada, Tokyo; Kazuo Murata, Tachikawa, both of Japan

[73] Assignee: Nissan Motor Company, Limited, Yokohama, Japan

[21] Appl. No.: 896,620

[22] Filed: Apr. 14, 1978

[30] Foreign Application Priority Data

Apr. 27, 1977 [JP] Japan ..... 52-52649[U]

[51] Int. Cl.[2] ..... B66B 9/20

[52] U.S. Cl. ..... 187/9 R; 414/670

[58] Field of Search ..... 187/9 R, 9 E; 180/54 E; 214/674, 673, 672, 671, 670, 660

[56] References Cited

U.S. PATENT DOCUMENTS

| | | | |
|---|---|---|---|
| 2,207,688 | 7/1940 | Ulinski | 214/672 |
| 2,368,121 | 1/1945 | Dunham | 180/54 E X |
| 2,915,210 | 12/1959 | Ehmann | 214/674 |
| 3,376,990 | 4/1968 | Latall | 214/671 |
| 4,015,738 | 4/1977 | Gibson et al. | 187/9 R X |

FOREIGN PATENT DOCUMENTS

| | | | |
|---|---|---|---|
| 826975 | 11/1969 | Canada | 214/672 |
| 1215143 | 11/1959 | France | 214/674 |

*Primary Examiner*—Joseph F. Peters, Jr.
*Assistant Examiner*—Milton L. Smith

[57] ABSTRACT

A bracket member which connects an axle shaft housing to the chassis of a fork lift truck and supports a tiltable mast, is formed with a circular recess into which fastening bolts and flanges of the axle shaft housing project for reducing the fork lift truck tread width.

3 Claims, 2 Drawing Figures

MAST SUPPORT CONSTRUCTION FOR FORK LIFT TRUCK

The present invention relates in general to a fork lift truck and more particularly to a mast support construction for a fork lift truck.

Among the fork lift trucks, there is a type in which the differential gear assembly cooperating with the front driving wheels is located nearer one of the wheels than the other, necessitating the axle shaft connected to the one wheel to be shorter than that to the other. Accordingly, when a small-sized fork lift truck of the above type is designed, to achieve compactness of the shorter axle shaft and its cooperating parts is very difficult without sacrificing the mechanical strength of the same. In fact, a complicated support means for the mast is usually attached in particular to the shorter axle shaft via housing means as well as to the other longer axle shaft.

Thus, an object of the present invention is to provide an improved mast support construction which is specially appropriate for a small-sized fork lift truck.

Another object of the present invention is to provide an improved mast support construction by which the tread width of the front driving wheels of the fork lift truck is considerably reduced.

Still another object of the present invention is to provide an improved mast support construction which induces a reliable connection between the truck body proper and the mast.

Figure 1:
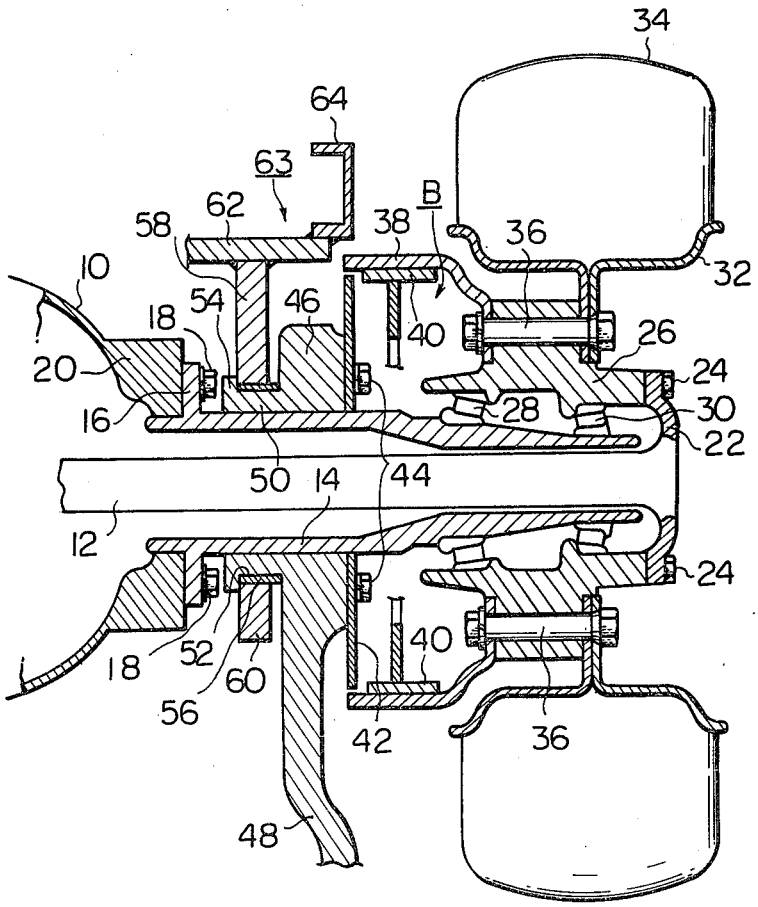
Fig. 1 PRIOR ART
Figure 2:
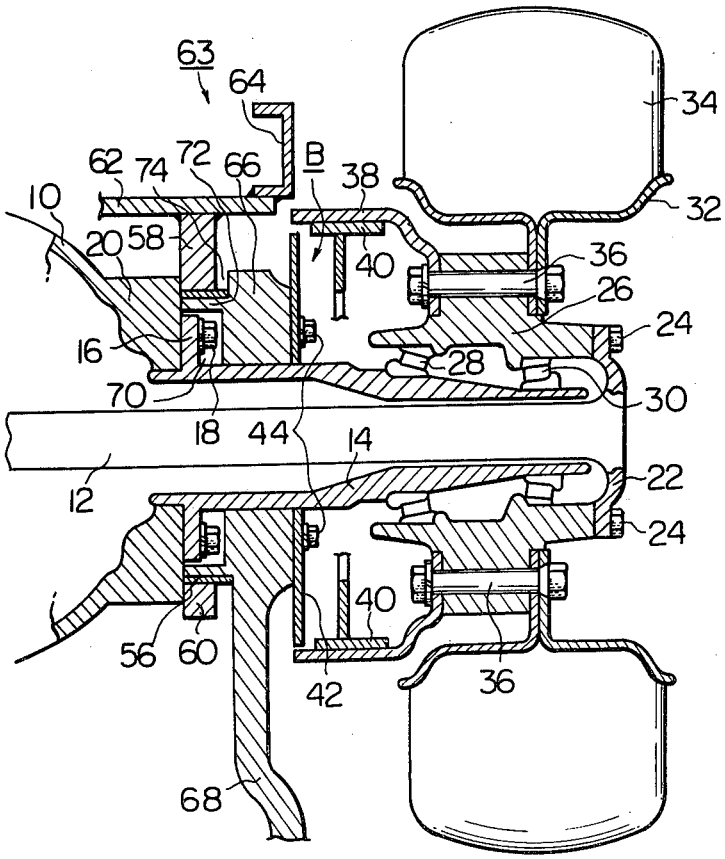

Other objects and advantages of the present invention will become apparent from the following detailed description when taken in conjunction with the accompanying drawings, in which:

FIG. 1 is a partial sectional view of a front-right portion of a conventional fork lift truck, showing a conventional mast support construction cooperating with one of the front-driving wheels; and FIG. 2 is a similar view to FIG. 1, but shows a preferred embodiment of the present invention.

Prior to describing construction of the improved mast support construction of the subject invention, description of a conventional mast support construction will be made with the aid of FIG. 1 in order to clarify the inventive features of the subject invention.

In FIG. 1, a conventional mast support construction is shown as being connected to a front-right portion of the fork lift truck. The front-right portion herein shown comprises a differential housing 10 in which well known differential gears (not shown) are operatively contained. Laterally extending from one of the gears (not shown) is an axle shaft 12 which is coaxially and spacedly received in a tubular axle shaft housing 14 fixed to the differential housing 10. As shown, the connection of the axle shaft housing 14 with the differential housing 10 is such that a flange 16 formed on an inboard end section of the axle shaft housing 14 is tightly connected via several bolts 18 to a flat base portion 20 formed on the differential housing 10. The leading end of the axle shaft 12 projects from the axle shaft housing 14 to form a flange 22 which is fixed through several bolts 24 to a hub 26. The hub 26 is concentrically disposed about the end portion of the axle shaft housing 14 via inner and outer bearings 28 and 30 to permit free rotation of the hub 26 and the axle shaft 12 relative to the axle shaft housing 14. A rim 32 which mounts thereon a tire 34 is connected by means of several fastening bolts 36 to an outer side of the hub 26 in a manner that the rim 32 and thus the tire 34 are concentric with the axle shaft 12. Fixed via the bolts 36 to an inner side of the hub 26 is a drum 38 constituting a part of a drum brake B, which drum is also concentric with the axle shaft 12. Within the drum 38 are located arcuate brake shoes 40 by which the rotation of the tire 34 is braked when they are brought into contact with the drum 38. A back plate 42 of the brake B is disposed about the axle shaft housing 14 to generally cover an open end of the drum 38 while leaving an annular clearance between the peripheral edge of the plate 42 and the leading edge of the drum 38, as shown. Usually, the backplate 42 is tightly fixed via bolts 44 to an axle mount bracket 46 which constitutes part of the mast support construction which will be described next in detail.

The mast support construction comprises the abovedescribed axle mount bracket 46 which has a bore (no numeral) through which an enlarged cylindrical section of the axle shaft housing 14 is force fitted. The bracket 46 is connected at its arm portion 48 to a body frame (not shown) of the fork lift truck. A hub portion 50 of the bracket 46 in which the bore is defined extends toward the before-mentioned flange 16 of the axle shaft housing 14 and is formed with an annular groove 52 and a radially extending end portion or flange portion 54, the annular groove 52 being formed so as to be concentric relative to the axle shaft 12. A segmented annular bush 56 made of thermosetting plastic typified by "Bakelite" is bonded to the bottom surface of the groove 52. The groove 52 receives therein the circular edge defining an opening (no numeral) formed in an arm member 58 in order that the arm member 58 is slidably rotatable about the bonded annular bush 56. Although not shown in the drawing, the arm member 58 consists of a main portion (58) with a semicircular recess formed therein and a cap portion 60 also formed with a semicircular recess, these two portions being connected to each other by bolts (not shown) so as to form or define a circular opening. Supported by the arm member 58 is a mast assembly 63 which generally includes a lateral bar 62 and a pair of channel-shaped masts 64 welded to the respective ends of the bar 62, (though one of the masts 64 is illustrated). A so-called cargo carrying base (not shown) is guided or supported by the mast assembly 63.

However, this conventional mast support construction has a limitation in reducing the axial length of the hub portion 50 because of the provision of the flange 16 and the fastening bolts 18 which axially project toward the hub portion 50. This induces a difficulty of reducing the tread width of the front driving wheels of the fork lift truck.

Referring to FIG. 2, there is illustrated a front-right portion of the fork lift truck in which a preferred embodiment of the mast support structure of the subject invention is operatively mounted. The front-right portion shown in this drawing generally comprises substantially the same parts as in the case of FIG. 1 except for the mast support structure. Thus, the same parts are designated by the same numerals as in FIG. 1 and the detailed explanation on these parts is omitted from the following.

The mast support construction of this invention comprises an axle mount bracket 66 which has a bore (no numeral) through which the enlarged cylindrical section of the shaft housing 14 is fittingly inserted. The bracket 66 is connected at its arm portion 68 to a body frame (not shown) of the fork lift truck. The hub portion of the bracket 66 in which the bore is defined is formed at a portion thereof facing the flange 16 with a circular recess 70, which is concentric with the axle shaft 12, leaving a cylindrical wall portion 72 which extends toward the flat base portion 20 of the differential housing 10. Specifically, the wall portion 72 contacts at its leading end the flat base portion 20 of the differential housing 10 so that the assembled flange 16 and the bolts 18 are received or enclosed in the circular recess 70, as shown. Thus, the inner diameter of the cylindrical wall portion 72 is formed greater than the diameter of the flange portion 16 of the axle shaft housing 14. About the outer cylindrical surface of the wall portion 72 is disposed, via adhesive, an annular bush 56 which is made of the afore-mentioned conventional material such as "Bakelite." It should be noted that the arrangement of the bush 56 on the wall portion 72 is such as to form a groove portion 74 which is defined radially outboard of the bush 56 and between the flat base portion 20 of the differential housing 10 and the bracket 66. A hub portion of the arm member 58 is slidably disposed about the bush 56 while keeping an inboard surface portion thereof in contact with the flat base portion 20 of the differential housing 10.

With this, it will be appreciated that since the laterally or axially projected parts or elements such as the bolts 18 and the flange 16 of the axle shaft housing 14 are wholly received in the circular recess 70 formed in the bracket 66, and the arm member 58 is disposed about the wall portion 72 by which the circular recess 70 is defined, the mast support construction can be made compact thus reducing the tread width of the fork lift truck.

What is claimed is:

1. A mast support construction for a fork lift truck having a body proper, a mast assembly located at one end of said body, a pair of driving road wheels located near said mast, and a differential housing positioned between said driving road wheels, said differential housing containing therein a differential gear mechanism which transmits a driving force from an engine to said driving road wheels through respective axle shafts, said mast support construction comprising:

an axle shaft housing spacedly receiving therein each of said axle shafts and having thereon a radially outwardly extending flange portion which abuts a base portion of said differential housing, said flange portion being secured to said differential housing by fastening means;

an axle mount bracket having a through bore through which said axle shaft housing is fittingly inserted so that said axle shaft housing is supported via said bracket by said body proper, said bracket being formed at a portion thereof facing said base portion of said differential housing with a circular recess defined within a cylindrical wall portion encircling said circular recess, said flange portion of said axle shaft housing being wholly received in said circular recess of said first bracket; and an arm member having a first portion thereof slidably disposed about said cylindrical wall portion and a second portion thereof to which said mast assembly is firmly fixed.

2. A mast support construction as claimed in claim 1, in which an annular groove is defined around said cylindrical wall portion between said base portion of said differential housing and a hub portion of said axle mount bracket, said groove slidably receiving therein a circular edge portion defining a circular opening formed in said first portion of said arm member so that said arm member can rotate about said cylindrical wall portion.

3. A mast support structure as claimed in claim 2, in which the inner diameter of said cylindrical wall portion is greater than the diameter of said flange portion of said axle shaft housing.

* * * * *